US006698386B1

(12) United States Patent
Hoffman

(10) Patent No.: US 6,698,386 B1
(45) Date of Patent: Mar. 2, 2004

(54) WATER HEATER

(75) Inventor: John M. Hoffman, Applegate, MI (US)

(73) Assignee: Safetp Engineering Laboratories, Inc., Warren, MI (US)

( * ) Notice: Subject to any disclaimer, the term of this patent is extended or adjusted under 35 U.S.C. 154(b) by 48 days.

(21) Appl. No.: 10/255,533

(22) Filed: Sep. 26, 2002

(51) Int. Cl.[7] ..... F22B 5/00

(52) U.S. Cl. ..... 122/14.31; 122/18.3; 122/19.2; 220/567.3

(58) Field of Search ..... 122/13.01, 14.31, 122/18.3, 19.1, 19.2, 494; 220/567.3, 495.01

(56) References Cited

U.S. PATENT DOCUMENTS

| | | | | |
|---|---|---|---|---|
| 2,334,398 | A | * 11/1943 | Farren et al. | 122/14.1 |
| 3,091,223 | A | * 5/1963 | Vitale | 122/18.2 |
| 4,940,042 | A | 7/1990 | Moore, Jr. et al. | |
| 5,020,512 | A | 6/1991 | Vago et al. | |
| 5,085,205 | A | 2/1992 | Hall et al. | |
| 5,361,729 | A | 11/1994 | Trihey | |
| 5,365,887 | A | 11/1994 | Fenn | |
| 5,533,495 | A | * 7/1996 | Moore, Jr. | 122/18.2 |
| 5,575,273 | A | 11/1996 | Moore, Jr. | |
| 5,765,547 | A | 6/1998 | La Plante | |
| 5,797,355 | A | 8/1998 | Bourke et al. | |
| 5,848,586 | A | 12/1998 | Garms | |
| 6,003,477 | A | 12/1999 | Valcic | |
| 6,035,812 | A | 3/2000 | Harrigill et al. | |
| 6,058,892 | A | * 5/2000 | Haack, II | 122/13.01 |
| 6,074,200 | A | 6/2000 | Bowman et al. | |
| 6,085,699 | A | 7/2000 | Valcic et al. | |
| 6,138,613 | A | 10/2000 | Bourke et al. | |
| 6,139,311 | A | 10/2000 | Bowman et al. | |
| 6,142,106 | A | 11/2000 | Overbey, Jr. et al. | |
| 6,164,486 | A | * 12/2000 | Jackson et al. | 220/612 |
| 6,196,164 | B1 | 3/2001 | Valcic | |
| 6,293,230 | B1 | 9/2001 | Valcic et al. | |
| 6,295,951 | B1 | 10/2001 | Valcic et al. | |
| 2001/0009144 | A1 | 7/2001 | Valcic | |
| 2001/0010209 | A1 | 8/2001 | Bourke et al. | |
| 2001/0011529 | A1 | 8/2001 | Bourke et al. | |

OTHER PUBLICATIONS

Brochure—American Water Heater Co., 2001—Proline Heater.

Brochure—American Water Heater Co., undated—Lime-Fighter.

Manual—Gas Water Heaters—ANSI Z21.10.1–1998—vol. 1.

* cited by examiner

*Primary Examiner*—Gregory Wilson
(74) *Attorney, Agent, or Firm*—James K. Poole, Esq.

(57) ABSTRACT

An improved gas-fired water heater is disclosed which comprises a sealed cylindrical shell extending from the base of the water tank to the top, enclosing the burners and controls so as to shield them from flammable vapors in the immediate vicinity. The cylindrical shell forms an annular passage outside the tank (and insulation, if present), which facilitates the intake of combustion air. This annular passage is shielded from above and the side adjacent the top of the tank by a cover fitted to the tank top which extends downward from the top to form a lip which laterally shields the annular passage and directs intake combustion air upward from outside the shell to enter the annular passage. The bottom of the heater can be extended by a cylindrical skirt extension which encloses the burner of the heater in an airtight manner except for air inlets in the bottom of the extension.

16 Claims, 5 Drawing Sheets

WATER HEATER

BACKGROUND OF THE INVENTION

1. Field of the Invention

The present invention relates to gas-powered water heaters, particularly those for residential use, and devices to shield the heating and pilot light burners from flammable vapors in the immediate area while improving air flow to the burners.

2. Description of the Relevant Art

Fuel-fired storage-type domestic water heaters are commonly used, and are popular because of their efficiency, economy and responsiveness compared with electric water heaters. Such devices are well known, and are described broadly in numerous publications, e.g. the background sections of U.S. Pat. Nos. 5,085,205 and 5,797,355. Such heaters can be used outdoors or indoors, but are typically used indoors, where the storage or spillage of flammable liquids or the like may give rise to hazards due to the close proximity of the heater pilot light, and heating burners and combustion air inlets to the floor, where such spillage typically takes place. These hazards are discussed at length in the patents just cited.

Various heater designs have been created, patented or produced to reduce or eliminate the hazards of the ignition of flammable vapors by the burners of the heater. Combustion air can be provided by direct venting from outside the heater space, which generally requires powered fans or other intake devices, takes considerable space for venting and is costly. Additionally, when a heater is provided air by venting from a distance, special control mechanisms must be provided to confirm the flow of air and the burning of the pilot light before the gas valve opens. Such controls are costly and prone to disrepair. Sealed combustion devices generally operate in a similar manner to vented systems, and have many of the same problems. Elevating a water heater on a stand at least 18 inches above the floor (in accordance with many building codes) is a simple mitigating method which is effective in many cases, but cannot prevent ignitions in all foreseeable circumstances.

Combustion air can be obtained from the immediate area of the heater via cylindrical enclosures which elevate the air intake further (resembling a "bucket"), or from elevated intake devices, collectively and informally referred to as "snorkels," but these are not much more effective and may also increase the cost of the basic water heater installation. Various types of flame arrestor devices have been used with gas-fired water heaters to prevent the ignition of flammable vapors in the vicinity of an operating heater, but such devices impose a cost for the safety features offered, and also a burden of maintenance since they may tend to become clogged with debris or otherwise malfunction.

Hall's U.S. Pat. No. 5,085,205 discloses an elevated air intake using an open "bucket" or cylindrical enclosure. Harrigill's U.S. Pat. No. 6,035,812 discloses a heater with a bottom air intake and flame arrestor system. Bourke's U.S. Pat. No. 5,797,355 discloses several systems having flame arrestors and elevated ("snorkel") air intakes. Heaters related to the latter patent are sold under the trademarks "FLAME GUARD" and "FLAME LOCK".

U.S. Pat. Nos. 5,575,273; 5,533,495 and 6,058,892 are related and relevant art, disclosing representative air intake systems. Moore's '273 and '495 patents are closely related, and disclose "balanced flue" heaters for outdoor use, having air intake openings on the upper vertical face of the outer jacket and ducts to carry the air down to the burner below the tank. FIG. 3 of the '495 patent shows an essentially annular air duct, interrupted only by blocks 74, while the '273 patent (FIGS. 1 & 2) shows a more conventional vertical air duct limited to only a portion of the annular space between tank and jacket. U.S. Pat. No. 6,058,892 discloses exterior tubular air intakes with open tops.

U.S. Pat. No. 5,765,547 discloses (see FIGS. 5/6, col. 8/9) a water heater with an exterior sealed shell forming a partial annular air passage for combustion air, with air entering side-opening vents at elevated positions above the middle of the heater.

U.S. Pat. No. 5,848,586 discloses a water heater with a "fire safety collar," including two concentric air baffles which shield the burner from flammable vapors and form an annular air duct for combustion air intake from a position above the base of the unit.

U.S. Pat. No. 5,361,729 discloses (in FIGS. 17–23 and related text) a gas water heater with a partitioned flue including rectangular air intakes. Columns 7/8 and FIG. 17 describe the use of tapered exhaust ducts to affect heat transfer.

U.S. Pat. No. 3,091,223 discloses a sealed vent water heater with a "snorkel" air intake.

U.S. Pat. No. 5,365,887 discloses an on-demand water heater and heat exchanger. FIGS. 1 and 6 show air entering the outer shell through open vents and passing downward through an apparently annular air intake to provide combustion air to a burner shielded from the exterior environment.

Bowman's U.S. Pat. Nos. 6,074,200 and 6,139,311 (the latter a CIP of the first), assigned to Gas Research Institute, disclose burner systems with the pilot light exposed to the ambient atmosphere to monitor the presence of flammable vapors and shut down the burners when necessary for safety purposes.

A large collection of patents was found which were all assigned to the same Australian company. Several of these patents are related as divisionals, continuations or continuations-in-part of older applications. Significant patents and disclosures include:

U.S. Pat. No. 6,138,613 discloses a "snorkel" intake using vertical-louvered air inlets. (Cont. Of U.S. Pat. No. 5,797,355)

U.S. Pat. No. 6,142,106 discloses air inlets with flame arrestors, designed to admit both air and extraneous vapors to the combustion chamber. U.S. Pat. No. 6,085,699, a CIP of U.S. Pat. No. 5,797,355, discloses similar air vents.

U.S. Pat. No. 5,797,355 discloses a gas water heater with a side-mounted "snorkel" intake having louvered air inlets.

U.S. Pat. No. 6,003,477 discloses snorkel intakes, both open and closed, and including flame traps. (CIP/CIP/CIP of U.S. Pat. No. 5,797,355)

U.S. Pub. No. 2001/0010209 (continuation of division of U.S. Pat. No. 5,797,355) also discloses vertical snorkel intakes with elevated louvered inlets.

U.S. Pat. No. 6,196,164, a division of U.S. Pat. No. 6,003,477, discloses vertical snorkel intakes with louvered inlets or open tops, and flame traps for use therein.

U.S. Pub. No. 2001/001529 (a continuation of division of U.S. Pat. No. 6,138,613, a continuation of U.S. Pat. No. 5,797,355) also discloses vertical snorkel intakes with elevated louvered air inlets.

U.S. Pub. No. 2001/0009144 (continuation of U.S. Pat. No. 6,196,164) discloses vertical snorkel intakes with elevated louvered air inlets and flame traps.

U.S. Pat. No. 6,293,230 discloses gas water heaters with air inlets/flame traps to admit both air and extraneous fumes to the combustion chamber.

U.S. Pat. No. 6,295,951 (CIP/CIP of U.S. Pat. No. 5,797, 355) discloses side-mounted snorkel intakes with flame traps.

Clearly, despite the efforts of many designers and manufacturers in the mature industry serving the residential water heater market, there remains the need for simple, economical yet effective means of providing an efficient and responsive water heater which is reasonably safe against the hazards of flammable vapors in the vicinity. Homeowners and other purchasers are sensitive to prices for such appliances, and will normally pay only a limited premium for safe heaters, while perhaps honoring fire safety precautions more in the breach than the observance.

SUMMARY OF THE INVENTION

It is an object of the present invention to provide apparatus which renders conventional fuel-fired water heaters safe in the presence of flammable vapors or other materials. Another object of the invention is to provide a smooth flow of combustion air from the vicinity of the heater to the combustion chamber of the heater without disruption from drafts, wind or other air disturbances, pressure fluctuations or the like. Still another object of the invention is to prevent any reversals of direction of the combustion air supply or exhaust fumes upon startup of the heater, exterior drafts or other unusual conditions. Yet another object of the invention is to prevent the entry of foreign particulate matter into the combustion air intake system. A further object of the invention is to improve the insulation of the water storage tank and/or to increase the temperature of the incoming combustion air to improve the combustion process. Still another object of the invention is to elevate the heater tank, combustion chamber intakes and burners sufficiently within the heater apparatus to optimize the flow of air (i.e., make it smooth and steady) from the intake system to the combustion chamber and reduce the chances of reversals of flow of combustion gases. A fundamental object of the present invention is to achieve at least a portion of the above objects without significant increases in material, manufacturing or installation costs. To be effective in reaching many consumers, even the best safety devices must be price-competitive and be simple to install, operate and repair or replace. Another significant object of the invention is to provide improved performance while meeting all applicable electrical safety and emissions standards and the like.

Some of the advantages provided by the apparatus of the invention include:

Significant reductions in the potential ignition of vapors from a flammable liquid spill;

Prevention of potential reversals of direction of combustion air supply and/or exhaust fumes upon burner start-up or in the presence of unusual external winds;

Additional insulation afforded by the exterior cylindrical shell and the air enclosed within, reducing heat losses from the stored hot water via convection, conduction and radiation mechanisms;

Heating of combustion air above ambient temperature as it passes through the annular air passage surrounding the tank, which improves combustion efficiency;

Essentially invulnerable to clogging by airborne debris which might clog flame-arrestor devices; and Minimal added material and manufacturing costs compared with conventional storage heaters.

These and other objects and advantages are attained by the apparatus and method of the present invention, comprising means for positioning a conventional gas-fired water heater within a shell having a solid base and an open top and configured to fit over the water heater to provide an annular passage between shell and heater which allows air to flow smoothly from an intake formed by a detachable cover atop the shell to the combustion chamber below. The heater is positioned and fastened within the shell so that the combustion chamber is located a vertical distance above the base of the shell effective to smooth (i.e., make non-turbulent) the flow of combustion air from the air intake to the combustion chamber without allowing reversals of flow of either the combustion air or combustion gases.

In a form which can be adapted to fit almost any conventional gas-fired water heater, the invention comprises a cylindrical shell adapted to enclose the heater, fitted with a solid base and sealed substantially air-tight except for an open top, the top being fitted with a detachable cover whose edge is displaced downward sufficiently to form a lip to deflect lateral air flow from outside the shell and direct air into the annular space formed between the tank and shell from below the cover and via an air intake. The shell preferably comprises an access door which can be removably closed air-tight and may contain a transparent portion for burner observation. The base of the shell can include support means to elevate the bottom of the shell above the floor where the unit is installed.

A method of installing a gas-fired water heater in the shell described above comprises steps of:

a) selecting the diameters of the heater and shell to establish an annular combustion air passage between the two which allows unrestricted air flow to the combustion chamber below;

b) adding a skirt extension with a solid bottom to the bottom of the heater, the skirt extension sealing the bottom of the heater except for a plurality of air intake holes in the extension bottom; then, c) inserting the heater into the shell and securing it in a centered position an effective distance above the base of the shell with securing means; and d) emplacing the cover of the shell atop the shell and heater to shield the annular passage from above, prevent lateral airflow into the passage and direct combustion air into the passage from below the cover.

In installing the shell on an existing heater, the heater with its skirt extension is positioned within the shell to emplace the main burner(s) of the heater an effective distance above the base of the shell to optimize air flow (i.e., make smooth and steady) to the burner(s) and prevent reversals of flow of either intake air or combustion gases. By installing a conventional gas-fired water heater with skirt extension in such a shell of the invention, an improved water heater of the invention is provided.

Further in accordance with the invention, an improved gas-tired storage water heater can be produced, comprising a storage tank fitted with a cylindrical shield, the shield having a solid base and being sealed substantially air-tight except at the top. The shield surrounds the tank so as to define an annular air passage between the outer surface of the heater and the inner surface of the shield, the width of the passage being selected to provide a smooth, unrestricted flow of combustion air to the burner(s) of the heater. The heater is elevated a sufficient distance above the base of the shell to smooth the flow of combustion air from the annular passage into the combustion chamber of the heater, and a cover with a downward-displaced edge forming a lip is emplaced atop the shell and heater to shield the annular passage from the top and sides, thus directing combustion air into the annular passage from below the cover with a substantial change of direction in the process.

Further refinements to this manufactured embodiment of the invention include a skirt extension which extends from the bottom of the heater to enclose the combustion chamber and burner(s) of the heater in an airtight manner except for a plurality of air inlets in the bottom of the skirt extension. These air inlets are provided in sufficient size and number and suitable arrangement in the skirt extension bottom, and the heater with extension installed is emplaced to position the burner(s) of the heater a sufficient distance above the base of the shell to optimize the flow of combustion air to the burner(s) and prevent reversals of flow of intake combustion air or combustion gases. Suitable support and attachment means are provided to position the heater within the shell to form a suitable annular passage and to elevate the heater (and skirt extension, when installed) an effective distance above the base of the shell. Support means can be fitted to the bottom of the shell to elevate the heater-containing shell above the floor where installed. At least one sealingly closable access door can be provided in the shell for access to components of the heater, optionally including a transparent portion for burner operation. The heater can include a layer of insulation surrounding at least the sides of the tank, which must be considered in selecting or constructing a shell of a particular diameter.

BRIEF DESCRIPTION OF THE DRAWINGS

A more complete appreciation of the invention and many of the objects and advantages thereof will be readily obtained by perusing the following detailed description and appended claims in combination with the accompanying drawings, wherein:

DETAILED DESCRIPTION OF PREFERRED EMBODIMENTS

Although the apparatus of the present invention will be described and illustrated as a complete, improved gas-fueled water heater apparatus, the principles of the invention can be applied to any heater apparatus heated by the combustion of fuels and potentially exposed to the hazards of flammable vapors in the vicinity. Furthermore, components of the apparatus comprising a concentric shell, cover and an extension skirt for conventional heaters can be provided to retrofit existing heaters to achieve the benefits of the invention. Naturally, it is most efficient and economical to manufacture and market complete units embodying all the advantages of the invention.

Figure 1:
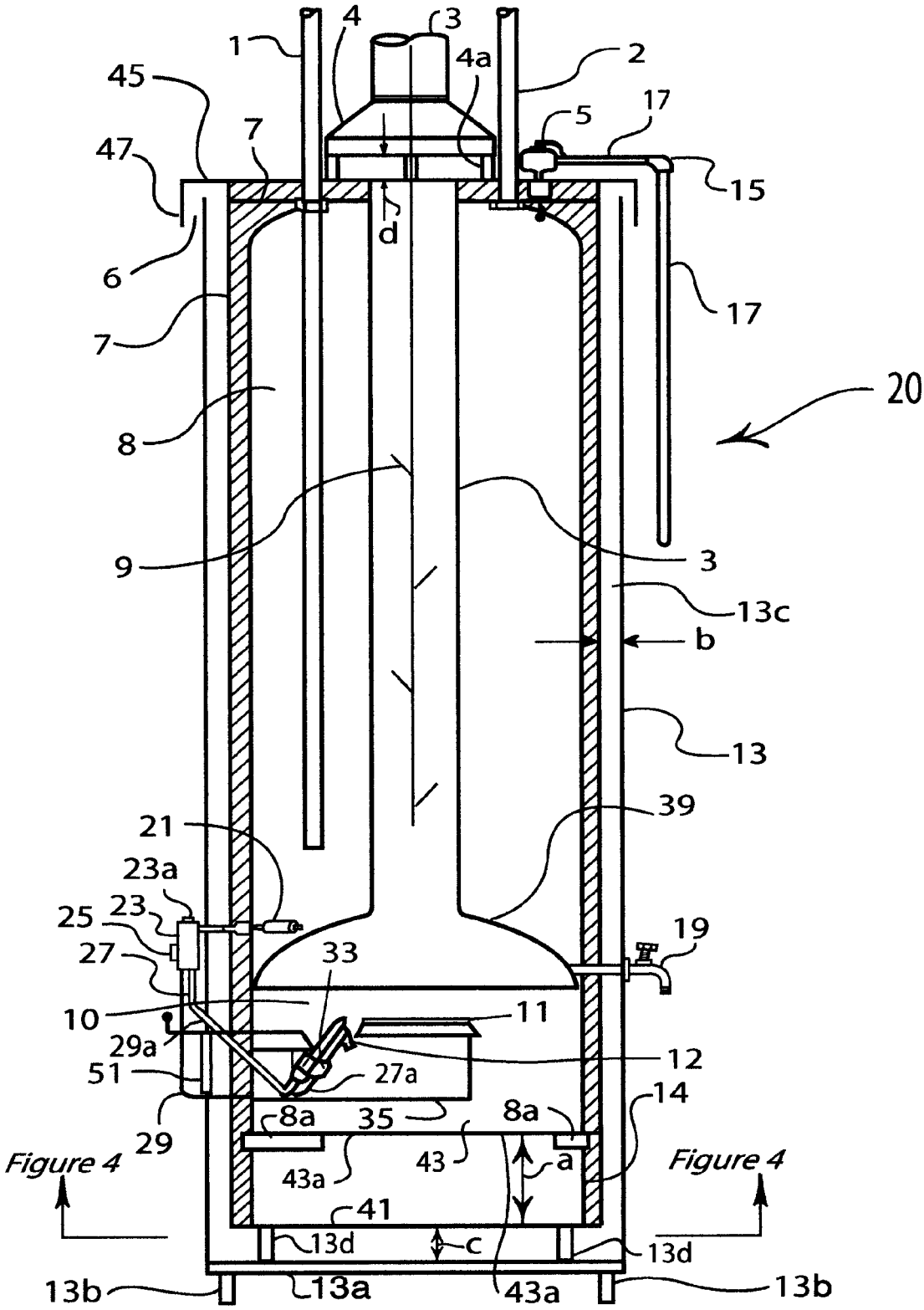
FIG. 1 is a cross-sectional vertical view of the apparatus of the invention.
Figure 2:
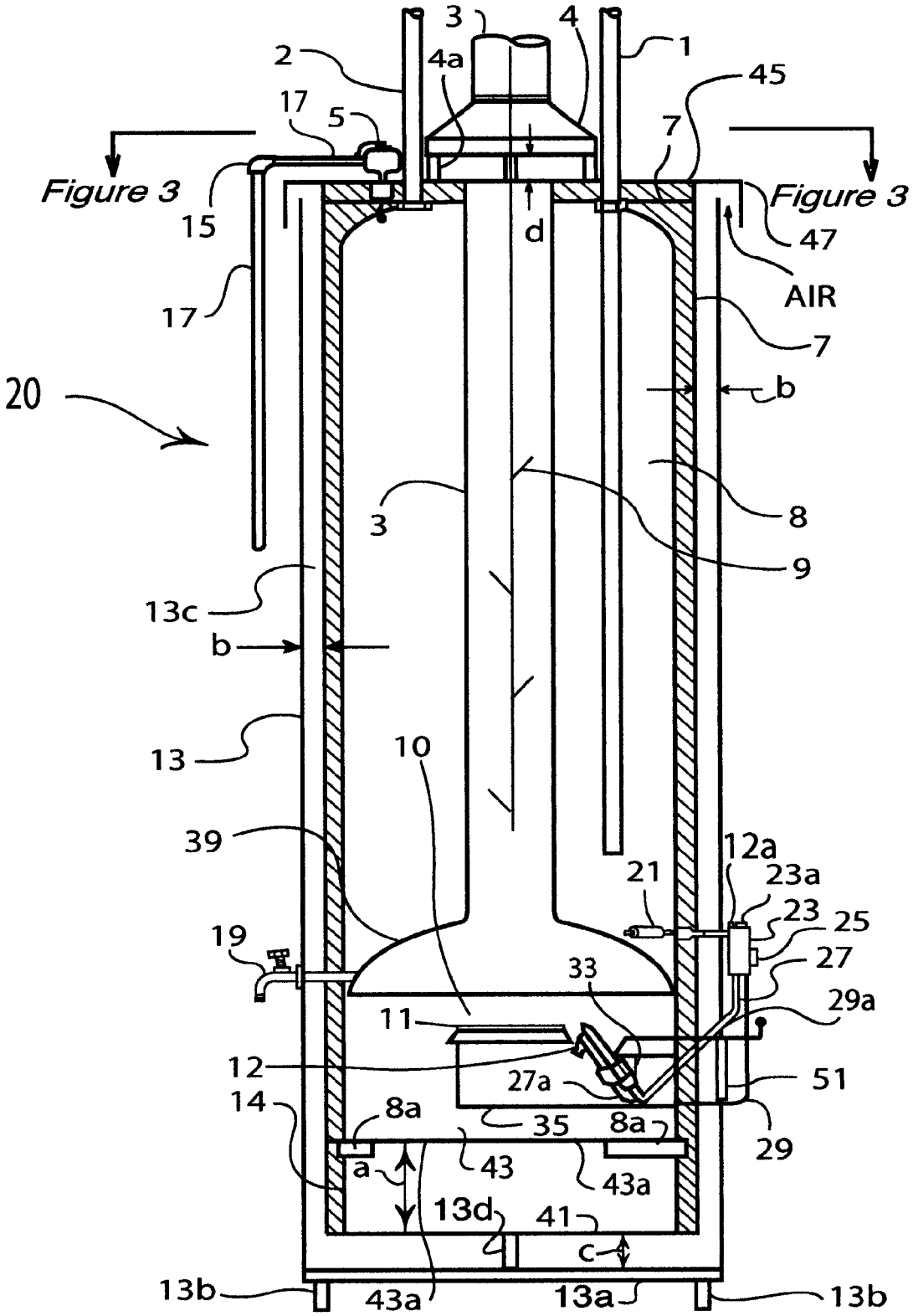
FIG. 2 is a cross-sectional vertical view of the apparatus from the opposite direction.

Turning now to the drawings, FIGS. 1 and 2 illustrate a gas-fired storage water heater 20 of the invention in cross section, viewed from two different sides. Water tank 8 is surrounded by insulation 7 except on the bottom. Cold water enters through inlet 1 and hot water exits through outlet 2. Flue 3 carries off combustion products, and is surrounded by draft diverter 4 which permits air balancing in the combustion flue in the event of back drafts or barometric pressure changes. Draft diverter 4 is elevated slightly above the tank top and the top of insulation 7 by supports 4*a*, which can be formed of any suitable material and in any suitable shape. It is convenient to form the supports from the same sheet metal used to form the draft diverter itself. The draft diverter 4 is positioned upon supports 4*a* so that the lower edge is an effective distance "d" from the topmost surface of the tank (and insulation, when present) to allow surges of air rushing down the upper flue to be discharged to the sides of the diverter rather than entering flue 3 within the heater in substantial amounts. Generally, the bottom edge of the diverter will be positioned about one inch from the topmost point of the tank top or insulation. It also provides for the ready escape of flue gases in the event of no draft, back draft or a blocked flue above the diverter; prevents back drafts from entering the heater; and neutralizes the potential effects of "stack action" (excessive air velocity through combustion area) upon the combustion process.

A conventional temperature and pressure relief valve 5, pipe elbow 15 and drain pipes 17 provide for the escape of excess hot water and/or steam in the event of overheating or overpressurization. Flue baffles 9 slow the flow of combustion gases through flue 3 to assist in transferring heat from combustion gases ascending flue 3 to the water inside tank 8. The dome-shaped bottom 39 of water tank 8 gathers the combustion gases from the combustion chamber 10 and directs them into flue 3, also serving as the bottom for tank 8.

Main fuel burner 11 burns the fuel (conventionally, natural gas, propane or other gaseous fuels) in combustion chamber 10, and is supported by burner support 35. Normally, a single burner as shown is employed, but more can be used if necessary. Gas provided to the main fuel burner 11 via tube 27 is ignited by pilot fuel burner 12, which is provided with a separate source of fuel via tube 27*a*.

The insulated water heater unit can be a conventional cylindrical tank 8 with insulation 7, plus a cylindrical skirt extension 14 at its base. If a conventional heater unit having a skirt 43 below burner 11 is adapted to the apparatus of the invention, any tank feet 8*a* which are present can simply be left in place. Such feet can be formed of stamped sheet metal, e.g. stamped from skirt bottom 43*a*, leaving vent holes therein (not shown). Skirt extension 14 terminates in a bottom 41, and this section is substantially air-tight except for air inlets 37 in bottom 41. (See FIG. 4.) Skirt extension 14 extends a distance "a" beyond the bottom 43*a* of the original heater skirt. The original heater skirt 43 extends from the bottom of the water tank and collector 39. The heater unit is positioned above the solid base 13*a* of cylindrical shell 13 by several feet 13*d* to provide a space "c" between bottom 41 of skirt extension 14 and shell base 13*a*. The distance c can generally be at least about one inch, and is chosen to provide unrestricted air flow to skirt extension bottom 41 from combustion air inlet 6 at the top of the unit. The distances a and c are selected to provide smooth and sufficient air flow to burner 11 while preventing reversals of flow of intake air or combustion gases. Whether the heater unit is assembled by adapting existing commercial models or manufactured to the specifications of the present invention, the main burner 11 should normally be at least about eight inches above air intakes 37 in skirt extension bottom 41 to achieve the desired effects. The heater unit can also be supported laterally within shell 13 by suitable braces or other mechanical means which are formed and installed to minimize interference with air flow. (Not shown here, but conventional water heaters use small stamped sheet metal positioning braces.)

The insulated tank with skirt extension 14 is installed in a cylindrical shell 13 which has an inner diameter sufficiently larger than the outer diameter of insulation 7 to define an annular air passage 13*c* with a width "b" between the shell and tank. The diameter of cylindrical shell 13 should be selected relative to the tank size to provide optimal (i.e., smooth, steady and sufficient) flow of combustion air and added insulation for the tank. The annular air passage 13*c* should generally have a width of at least about one inch, but can be smaller or larger. Increasing the width of the passage will generally increase the insulating effect, decrease the velocity of air flow and decrease pressure drops through the annular passage.

Air inlets 37 in skirt extension bottom 41 (shown in FIG. 4) are suitably located in sufficient numbers and sizes to provide ample flow of combustion air to the burner and combustion chamber and avoid reversals of flow of either combustion air or combustion gases. Generally at least about four circular air inlets with diameters ranging from about two to about three inches will suffice, providing a total cross sectional area in the range of from about twelve to about thirty square inches. Cylindrical shell 13 is fitted with a solid base 13*a* which preferably has several feet or spacers 13*b* attached to the base to elevate the shell base slightly above the floor. Such feet or spacers should be at least about one inch high.

Circular cover 45 is fitted to the top of tank 8, atop insulation 7, fitting under draft diverter 4. The cover is penetrated by water pipes and other necessary hardware entering the top of the tank. Cylindrical shell 13 is fitted and positioned so that the insulated top of tank 8 protrudes slightly above the top edge of the shell, with cover 45 extending beyond the edge of shell 13 to define a combustion air intake 6 between cover 45, insulation 7 and the upper edge of shell 13, leading into annular passage 13*c*. Cover 45 is bent or otherwise deflected downward to provide a lip 47 which acts as a lateral shield for air intake 6, thus preventing external drafts or winds from disrupting the smooth flow of intake air. As shown, cover 45 has its outer edge bent at right angles to form a lip 47, but the lip can be formed by bending this edge downward at an acute angle from the horizontal, forming a radial bend, or any effective means of shielding air intake 6 laterally from drafts and controlling the cross section of the aperture through which air flows into the air intake 6. Preferably, the gap between shell 13 and lip 47 should measure at least about one inch.

The components of the water heaters disclosed and claimed herein are assembled and adjusted so that the completed heater meets customary standards for Carbon Monoxide emissions and meets or exceeds Underwriters Laboratory requirements, and including American National Standard Z21.10.1-1998 for producing Carbon Monoxide of 400 ppm or less.

Figure 5:
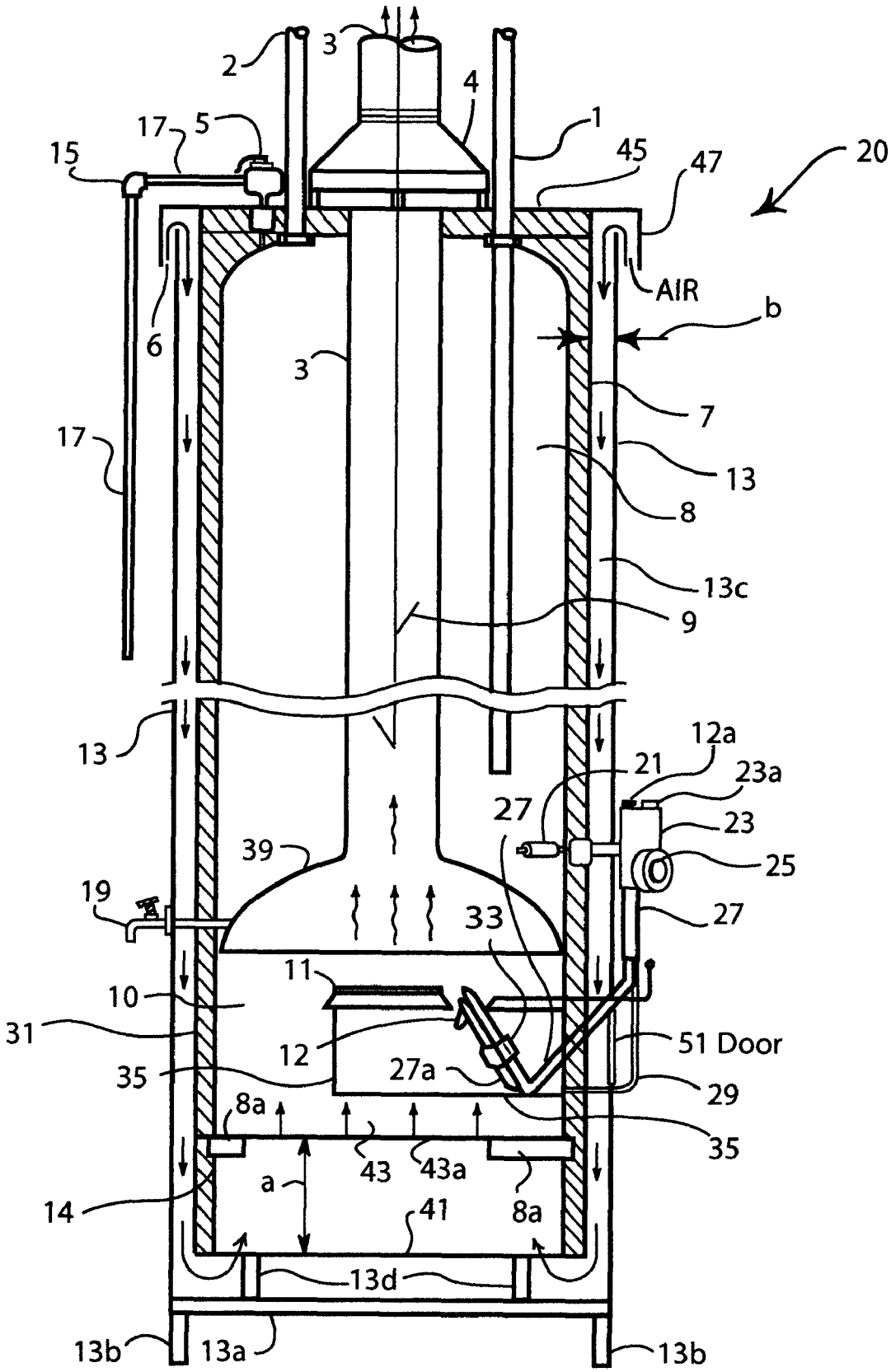
FIG. 5 is a partial sectional vertical view illustrating the flow of combustion air.
Figure 6:
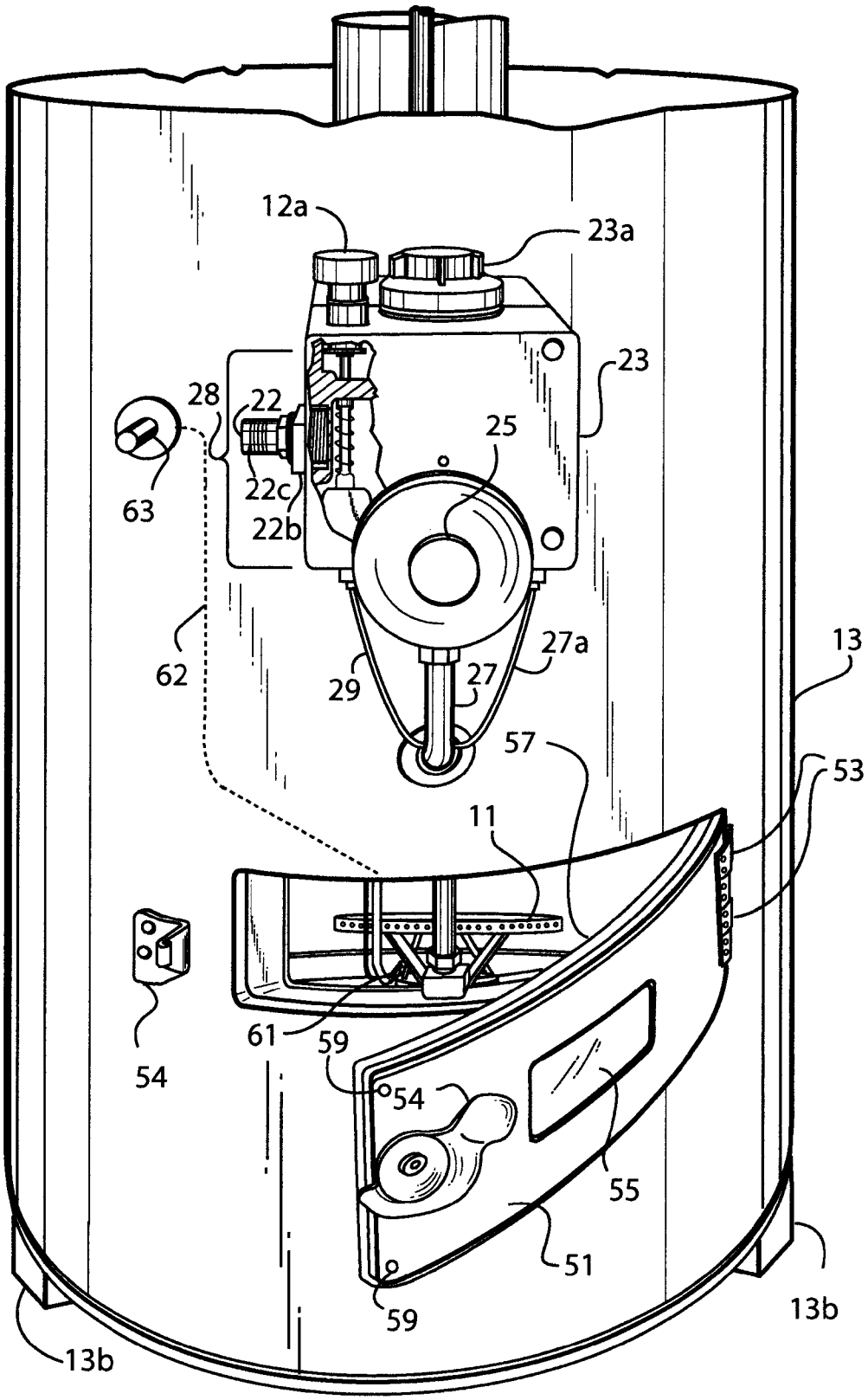
FIG. 6 is a partial perspective view illustrating an access door and controls.

Additional details of the heater apparatus, most of which are conventional and not essential components of the present invention, are also shown in FIGS. 1 and 2 et al. A conventional drain valve 19 is provided near the bottom of the tank. As shown in FIGS. 2, 5 and 6, gas valve 23 receives gas from a conventional gas inlet 22 (including securing nut 22*a* and threads 22*b*), and includes a probe 21 which extends through the tank shell into the water space to measure the water temperature. (Gas inlet 22 omitted in other figures for clarity.) Probe 21 transmits the temperature to a compound bar thermostat (not shown here) within gas valve 23, which can be set to the desired set temperature by knob 25, which controls the water temperature selector valve 26 (not shown here). This control sets the temperature and controls the temperature selector valve 26 within gas valve 23 so that it opens to allow gas to flow to burner 11 via gas line 27 when the water temperature falls below a certain level. Gas at main burner 11 is ignited by pilot light 12. At the pilot light 12, a thermocouple 33 provides a voltage via thermocouple line 29 to gas inlet safety valve 28 in gas valve 23. Gas for pilot light 12 is controlled by pilot gas control valve 12*a* atop gas valve 23. As long as pilot light 12 is burning, this safety valve 28 is held open against a closing spring force. If the pilot flame goes out, this valve closes, stopping all gas flow through gas valve 23. Conventional gas control knob 23*a* atop gas valve 23 has three positions: off, pilot and on. In the pilot position, the pilot gas control valve 12*a* is depressed, which manually holds the safety valve 28 open and permits gas to flow to pilot light 12. Once thermocouple 33 heats up, the safety valve will stay open and the knob is released. Knob 23*a* can then be turned to the on position, allowing gas to flow to main burner 11 as demanded by the thermostat and controlled by the temperature selector valve 26.

Access door 51 (See FIG. 6) is attached to shell 13 by hinge means 53 to allow access to burner 11 and other internal components. A transparent window 55 can be provided for direct observation of the burner 11 and pilot light 12. Door 51 seats on an elastomeric, heat-resistant seal 57 to provide an airtight seal, and is secured by suitable latch means 54. Suitable interlocks (not illustrated) can optionally be provided to disconnect electricity and gas flow when the door is opened. Optionally, additional securing means 59, such as a bolt with wing nut fastener or other suitable mechanical fastener, can be used to prevent easy opening of the door by children. Optionally, a piezoelectric lighter 61 activated by a mechanically connected push button control 63 located in any suitable position (such as the exterior shell 13 as shown) and connected via electrical line 62 can be provided for easy lighting of pilot light 12.

Figure 3:
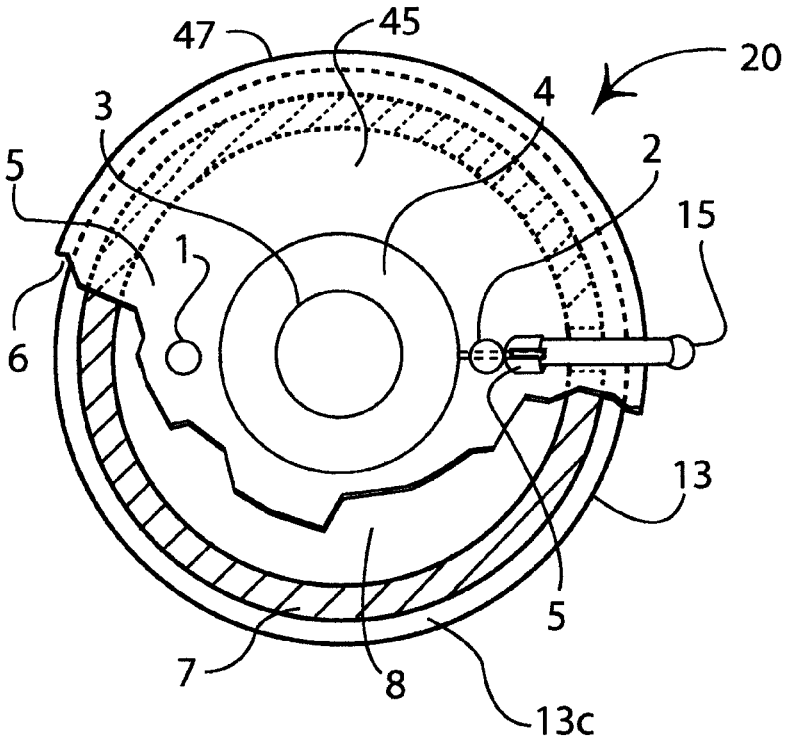
FIG. 3 is a top cutaway view of the apparatus.

FIG. 3, a top view of the apparatus, illustrates the relationship of cover 45 to draft diverter 4, flue 3, water pipes 1 and 2, etc. As shown in FIGS. 1 and 2, cover 45 covers the entire top of the unit, extending beyond the outer surface of shell 13 and with lip 47 laterally shielding air inlet 6.

Figure 4:
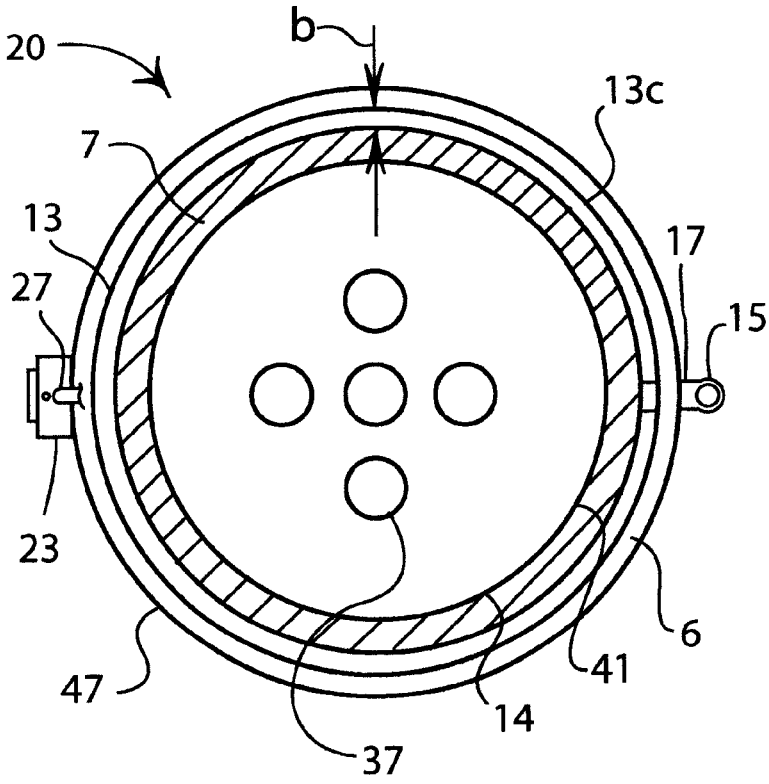
FIG. 4 is a bottom sectional view of the apparatus.

FIG. 4 is a sectional view showing the bottom of the insulated tank unit 7/8 just above base 13*a* of cylindrical shell 13. Air inlets 37 are cut into skirt extension bottom 41 (of skirt extension 14), and are sized, located and spaced to provide ample flow of combustion air. The annular space 13*c* between shell 13 and tank insulation 7 normally has a uniform width b from top to bottom and around the circumference of the tank, but can be varied if necessary to influence the flow of combustion air. (See U.S. Pat. No. 5,361,729, for example.)

FIG. 5 illustrates the flow of air and gases from outside the unit, into the combustion chamber and out the flue. Air enters the air intake 6 at the top of the unit, well above the floor level or the level which any flammable vapors might reach after a spill or the like. The air cannot enter directly into the space between cover 45 and insulation 7, but must enter from below lip 47 of cover 45 and perform a substantial reversal in direction in passing around the upper edge of shell 13 and entering annular passage 13*c*. Normally the unit will be placed so that air can enter freely from all directions, passing downward through annular passage 13*c* around the circumference of the insulated tank, where it absorbs heat from insulation 7 and is preheated as combustion air.

The downward-flowing combustion air is then channeled along base 13*a* of shell 13 and passes upward through air inlets 37 in skirt extension bottom 41. The combustion air then passes upward through skirt extension 14, passing through holes (not shown) in bottom 43*a* of heater skirt 43 to reach combustion chamber 10, where it mixes with fuel flowing from gas line 27 via main burner 11. Once this fuel-air mixture is ignited by pilot burner 12, it burns steadily to produce hot combustion gases which flow into the concave hood formed by the underside of tank bottom 39 and up flue 3, with baffles 9 slowing their flow to enhance the transfer of heat to tank 8 and the water contained therein. The use of hot water from the storage tank will trigger the input of cold water to be heated, with the main burner actuated by conventional "on-off" controls to achieve a temperature level according to the setting of a conventional thermostat, as described above.

Since the insulated water heater unit is sealed within cylindrical shell 13, with combustion air entering only near the top of the unit, flammable LIQUID vapors in the area (always heavier than air,) cannot be exposed to either the pilot or main burners. The configurations of the annular passage between the shell and insulated tank and the shielding lip of cover provide a smooth, steady and ample flow of combustion air from outside the unit to the combustion chamber without any adverse effects from outside drafts, winds or the like. Similarly, this configuration and the arrangements of burners, flue and other components prevent reversals of flow of either the intake air or exhaust fumes due to any irregularities in combustion.

Various conventional materials are suitable for constructing the heaters of the present invention. For example, carbon steel is suitable for the tank, and various types of sheet metal for the outer shell, flue ducting and the like. Glass tank linings can be used. Various types of polymeric composites could be used for the outer shell and other components which are intended to insulate rather than conduct heat, but sheet metal will generally be less expensive. Gas tubing, burners, etc. can be conventional metal components complying with local building codes. The insulation can be various types of foamed or fibrous insulation such as fiberglass, but a protective enclosing surface of metal foil or other suitable material should be provided if fibrous insulation is used. Shell 13 should be sealed gas tightly to base 13*a* so that no openings or breaks remain upon assembly and installation. Gas, water, electrical, control, or other connections, fittings, or plumbing, wherever they may pass through shell 13, base 13*a* or cover 45, can be sealed airtight. However, the joining or mating areas of base 13*a* to shell 13 and all service entries or exits to shell 13 need not be sealed airtight providing that they are designed and constructed as allowing only minor surface to surface clearances or gaps, each of which is capable of acting as flame quenching traps. The design and assembly of such service entries or exits is known in the art and not described herein. It is preferred, however, that the space defining combustion chamber 10 around main burner 11 be substantially air/gas tight except for the means provided to supply combustion air.

Clearly, numerous modifications and variations of the present invention are possible in light of the above teachings. It is therefore to be understood that within the scope of the appended claims the invention may be practiced otherwise than as specifically described herein.

I claim:

1. A cylindrical shell adapted to enclose a gas-fired storage water heater having a combustion chamber near the bottom of the tank thereof, fitted with a solid base and sealed substantially air-tight except for an open top, which top is fitted with a detachable cover whose edge is displaced downward sufficiently to form a lip to deflect lateral air flow from outside said shell and direct air into the interior of said shell from below said cover, said shell further comprising an access door which can be closed air-tight and comprises a transparent portion for burner observation.

2. The shell of claim 1 which has sufficient height to enclose a gas-fired storage water heater completely, establishing an annular passage between said heater and said shell to provide a smooth flow of combustion air to the heater combustion chamber, with said cover installed atop said heater and above the top of said shell to allow flow of combustion air into said annular passage.

3. The shell of claim 2 wherein said shell has sufficient height to position the main burner of said water heater a sufficient distance above the base of said shell to provide smooth air flow to said burner and prevent reversals of intake air and/or combustion gases.

4. The shell of claim 1 which further comprises support means to elevate the base of said shell above the floor where the unit is installed.

5. A method of installing a gas-fired storage water heater in the shell of claim 1, comprising steps of:

a) selecting the diameters of said heater and said shell to establish an annular combustion air passage therebetween which allows smooth, unrestricted air flow;

b) adding a skirt extension with a solid bottom to the bottom of said heater, said skirt extension sealing the bottom of said heater except for a plurality of air intake holes in said extension bottom;

c) inserting said heater into said shell and securing it in a centered position an effective distance above the base of said shell with securing means; and d) emplacing said cover of said shell atop said heater and above the top of said shell to shield said annular passage from above, prevent lateral airflow into said passage and direct combustion air into said passage from below said cover.

6. The method of claim 5 wherein said heater with said skirt extension is positioned within said shell to emplace the main burner of said heater an effective distance above the base of said shell to provide a smooth air flow to said burner and prevent reversals of flow of intake air and/or combustion gases.

7. An improved water heater assembled in accordance with claim 6.

8. A gas-fired storage water heater comprising a combustion chamber comprising at least one burner and a tank fitted with a cylindrical shell, said shell having a solid base and being sealed substantially air-tight except at the top, said shell surrounding said tank and defining an annular air passage between the outer surface of said heater and the inner surface of said shell, the width of said passage being selected to provide a smooth flow of combustion air to the burner(s) of said heater, with said heater being elevated sufficiently above the base of said shell to provide a smooth flow of combustion air from said annular passage into the combustion chamber of said heater, and a cover with a downward-displaced edge forming a lip being emplaced atop said heater and above the top of said shell to shield said annular passage from the top and sides, thus directing combustion air into said annular passage from below said cover, said heater further comprising a skirt extension which extends from the bottom of said heater to enclose the burner(s) of said heater in an airtight manner except for a plurality of air inlets in the bottom of said skirt extension.

9. The water heater of claim 8, further comprising support means fitted to the bottom of said shell to elevate said heater and shell above the floor where installed.

10. The water heater of claim 8, wherein said air inlets are provided in sufficient size and number and suitable arrangement, and said heater with said extension is emplaced to position the burner(s) of said heater a sufficient distance above the base of said shell to provide a smooth flow of combustion air to said burner(s) and to prevent reversals of flow of intake combustion air and/or combustion gases.

11. The water heater of claim 8, further comprising at least one sealingly closable door in said shell for access to components of said heater.

12. The water heater of claim 11, wherein said door comprises a transparent portion for burner observation.

13. The improved water heater of claim 8 which further comprises a layer of insulation surrounding at least the sides of said tank.

14. In a gas-fired storage water heater comprising a cylindrical storage tank, combustion chamber, burner, gas supply and control means therefor, flue, heat exchange means and water intake and exhaust means, the improvement comprising:

a) a cylindrical shell enclosing said heater, having a solid base and being substantially air-tight except at the top thereof, with b) the bottom of said heater being elevated sufficiently above the base of said shell to provide a smooth flow of combustion air to said combustion chamber;

c) said shell being adapted and installed to provide an annular passage between said heater and said shell sufficiently wide to provide a smooth flow of said combustion air and stabilize said heater in position;

d) a round cover installed atop said heater and positioned sufficiently above the top of said shell to allow air to flow into said annular passage, the border of said cover extending beyond said shell and being deflected downward sufficiently to form a lip to prevent the direct lateral entry of air and direct the entry of air from below said cover into said annular passage; and e) further comprising a skirt extension which extends from the bottom of said heater to enclose the burner of said heater in an airtight manner except for a plurality of air inlets in the bottom of said skirt extension.

15. The improved water heater of claim 14 which further comprises a layer of insulation surrounding at least the sides of said tank.

16. The water heater of claim 14, wherein said air inlets are provided in sufficient size and number and suitable arrangement, and said heater with said extension is emplaced to position the burner of said heater a sufficient distance above the base of said shell to provide a smooth and sufficient flow of combustion air and to prevent reversals of flow of intake combustion air or combustion gases.

* * * * *

UNITED STATES PATENT AND TRADEMARK OFFICE

CERTIFICATE OF CORRECTION

PATENT NO. : 6,698,386 B1
DATED : March 2, 2004
INVENTOR(S) : John M. Hoffmann

It is certified that error appears in the above-identified patent and that said Letters Patent is hereby corrected as shown below:

Title page,
Item [75], Inventor's surname should read -- Hoffmann; --

Column 4,
Line 57, correct first phrase to read -- gas-fired --.

Signed and Sealed this

Twenty-sixth Day of October, 2004

JON W. DUDAS
*Director of the United States Patent and Trademark Office*

UNITED STATES PATENT AND TRADEMARK OFFICE

CERTIFICATE OF CORRECTION

PATENT NO. : 6,698,386 B1
DATED : March 2, 2004
INVENTOR(S) : John M. Hoffmann

It is certified that error appears in the above-identified patent and that said Letters Patent is hereby corrected as shown below:

Title page,
Item [73], Assignee, correct the first word of the assignee's name to read -- Safety --.

Column 6,
Line 55, correct "c" to read -- c --;
Line 60, correct letters to read -- a -- and -- c --.

Column 8,
Line 53, correct letter to read -- b --.

Signed and Sealed this

Seventh Day of June, 2005

JON W. DUDAS
*Director of the United States Patent and Trademark Office*